US011820478B2

(12) United States Patent
Arvidsson

(10) Patent No.: US 11,820,478 B2
(45) Date of Patent: Nov. 21, 2023

(54) ELECTRICAL STEERING SYSTEM IN A MARINE VESSEL AND A METHOD FOR CONTROLLING SUCH A STEERING SYSTEM

(71) Applicant: AB VOLVO PENTA, Gothenburg (SE)

(72) Inventor: Lennart Arvidsson, Kållered (SE)

(73) Assignee: AB VOLVO PENTA, Gothenburg (SE)

( * ) Notice: Subject to any disclaimer, the term of this patent is extended or adjusted under 35 U.S.C. 154(b) by 225 days.

(21) Appl. No.: 17/423,714

(22) PCT Filed: Jan. 18, 2019

(86) PCT No.: PCT/EP2019/051259
§ 371 (c)(1),
(2) Date: Jul. 16, 2021

(87) PCT Pub. No.: WO2020/147967
PCT Pub. Date: Jul. 23, 2020

(65) Prior Publication Data
US 2022/0348301 A1 Nov. 3, 2022

(51) Int. Cl.
*B63H 20/12* (2006.01)

(52) U.S. Cl.
CPC ..... *B63H 20/12* (2013.01)

(58) Field of Classification Search
CPC ..... B63H 20/12
See application file for complete search history.

(56) References Cited

U.S. PATENT DOCUMENTS

2007/0197110 A1 8/2007 Takada et al.
2012/0083172 A1 4/2012 Al Babtain
2014/0106631 A1 4/2014 Ito

FOREIGN PATENT DOCUMENTS

CA 2430552 A1 11/2003
CA 2431036 A1 11/2003
(Continued)

OTHER PUBLICATIONS

International Search Report and Written Opinion dated Sep. 25, 2019 in corresponding International PCT Application No. PCT/EP2019/051259, 12 pages.
(Continued)

*Primary Examiner* — Stephen P Avila
(74) *Attorney, Agent, or Firm* — Venable LLP; Jeffri A. Kaminski

(57) ABSTRACT

A device and a method for controlling an electrical steering system in a marine vessel comprising at least one steerable propulsion unit, the electrical steering system comprising a main steering system (220; 220.1) that comprises a main electric motor (221; 221.1) and a main power source, e.g. a main battery (229; 229.1); a main steering angle sensor (226; 226.1) arranged to detect the steering angle of the propulsion unit; a main control unit (240; 240.1) arranged to steer the propulsion unit and to monitor the main steering system status; an auxiliary steering system comprising an auxiliary electric motor (231; 231.1) and an auxiliary battery (239; 239.1); and an auxiliary clutch (232; 232.1) arranged to connect a drive shaft of the auxiliary electric motor to the input shaft of the steering transmission (223; 223.1). The method involves the steps of engaging the auxiliary clutch at start-up of the propulsion unit; performing a diagnostic test of the main steering system during start-up; performing a calibration of an auxiliary steering angle sensor.

15 Claims, 6 Drawing Sheets

(56) References Cited

FOREIGN PATENT DOCUMENTS

| | | | | |
|---|---|---|---|---|
| CA | 2527075 | A1 | 5/2006 | |
| CN | 1636825 | A | 7/2005 | |
| CN | 104828231 | A | 8/2015 | |
| CN | 108430868 | A | 8/2018 | |
| DE | 102007048061 | A1 | 4/2009 | |
| EP | 2218639 | A1 * | 8/2010 | ..... B63H 25/24 |
| EP | 2218639 | A1 | 8/2010 | |
| JP | 2011063064 | A | 3/2011 | |
| WO | 2017002875 | A1 | 1/2017 | |

OTHER PUBLICATIONS

Chinese Office Action dated May 15, 2023 in corresponding Chinese Patent Application No. 201980088906.4, 20 pages.

* cited by examiner

ELECTRICAL STEERING SYSTEM IN A MARINE VESSEL AND A METHOD FOR CONTROLLING SUCH A STEERING SYSTEM

CROSS-REFERENCE TO RELATED APPLICATIONS

This application is a U.S. National Stage application of PCT/EP2019/051259, filed Jan. 18, 2019, and published on Jul. 23, 2020, as WO 2020/147967 A1, all of which is hereby incorporated by reference in its entirety.

TECHNICAL FIELD

The invention relates to an electrical steering system for a pod, or azimuth thruster in a marine vessel and a method for controlling such a system.

BACKGROUND

The invention can be applied to a marine vessel equipped with a pod or azimuth thruster propulsion system, also referred to as an inboard performance system (IPS). The pod provides both propulsion and steering functions and may be used singly or in pairs. The pod is made up of two units. The first, the upper pod unit, connects to an engine via a driveshaft and contains the gearing and steering functions. The second, the lower pod unit, mounts at least one propeller. The lower pod unit is external of the hull of the marine vessel and rotates relative to the upper pod unit to provide steering.

In vessels equipped with multiple pods it is possible to use one or more pods as a redundant system if a fault occurs in the steering system one pod. In vessels equipped with a single pod or steerable propulsion unit this is not an option. A known backup system is described in US2007197110A. In this example, it is possible to switch from an electric steering mechanism to a hydraulic steering mechanism in case of a failure in the electrical system. However, such a system is complex as it requires both a source of electrical power and a source of hydraulic pressure. The system also requires a significant amount of space. Further, in vessels equipped with multiple pods, wherein a fault occurs in the main electrical steering system, none of the pods may be operational for use in a limp-home condition. In such cases, a back-up system would be required, such as a hydraulic steering mechanism as described above. The same problems relating to system complexity and space requirement would apply is this case.

Hence there is a need for an improved steering system that solves the above-mentioned problems in vessels equipped with at least one pod or steerable propulsion unit.

SUMMARY

An object of the invention is to provide a steering system and a method for controlling the system, which steering system provides a reliable and compact steering arrangement in marine vessels equipped with at least one pod or steerable propulsion unit.

The object is achieved by method for controlling an electrical steering system and an electrical steering system according to the appended claims.

In the subsequent text, the term "electric motor" can include any suitable electrical actuator for controlling a marine steering system. Further, the term "steerable propulsion unit" should be interpreted as including a steerable pod, an azimuth thruster propulsion system, an Inboard performance system (IPS) or a similar steerable propulsion unit such as a stern drive or an outboard engine. According to the invention, electrical motors or actuators can be powered by a suitable source of electrical power. A non-exhaustive list of such power sources includes electric generators, electric accumulators, rechargeable batteries or fuel cells. In the subsequent text the term "battery" will be used to denote such power sources.

According to a first aspect of the invention, the object is achieved by method for controlling an electrical steering system in a marine vessel comprising a steerable propulsion unit having a main steering system comprising a main electric motor or actuator and a main power source providing electrical power to the main steering system and the main electric motor for steering control.

Further, a main brake can be arranged adjacent the main electric motor or actuator. The main brake can be controlled between an engaged state and a disengaged state. When engaged, the main brake prevents rotation of the main electric motor and an input shaft of a steering transmission in order to lock the propulsion unit in position. When the vessel is being operated and/or in response to a steering command, the main brake is disengaged. The main brake can be used for maintaining the propulsion unit in a straight-ahead midship position when the vessel is not being operated, or for assisting the steering system in holding the propulsion unit at a requested steering angle during operation of the vehicle. The main brake is preferably an electromagnetic brake or clutch, but it can also be hydraulically operated. In text, the term "main brake" is used for this component.

The transmission is located between a fixed upper portion, or upper pod of the propulsion unit and a rotatable lower portion, or lower pod of the propulsion unit. A main helm controlled by an operator is provided for steering the propulsion unit. A main steering angle sensor is provided for detecting the steering angle of the propulsion unit. The main steering angle sensor is preferably a resolver. A resolver is a type of rotary electrical transformer used for measuring degrees of rotation and can comprise either an analogue device, such as a brushless transmitter resolver, or a digital device, such as a rotary or pulse encoder. The main steering angle sensor is arranged in the steering transmission and detects the true steering angle of the propulsion unit. A main control unit is arranged to steer the propulsion unit in response to an input from an operator at the main helm and to continuously monitor the main steering system status.

The electrical steering system further comprises an auxiliary steering system comprising an auxiliary electric motor and an auxiliary battery providing electrical power to the auxiliary steering system and the auxiliary electric motor. An auxiliary clutch is arranged to connect a drive shaft of the auxiliary electric motor to the input shaft of the transmission in order to steer the propulsion unit, if and when the main steering system is malfunctioning. When a fault is detected in the main steering system the main control unit is arranged to disengage the main brake and engage the auxiliary clutch. At the same time the main electric motor coils can be de-magnetized to eliminate losses in the main steering system while the auxiliary steering system is operated.

According to the invention, the method involves controlling an electrical steering system as described above. The method involves the steps of:

engaging the auxiliary clutch at start-up of the propulsion unit;

performing a diagnostic test of the main steering system during start-up of the propulsion unit;

performing a calibration of an auxiliary steering angle sensor in the auxiliary steering system; and disengaging the auxiliary clutch upon completion of the diagnostic test.

According to the method, the diagnostic test is performed during start-up of the propulsion unit, which is initiated by starting up a drive unit for the propulsion system. Starting up the drive unit can involve cranking an internal combustion engine or powering up the power electronic circuits of an electric drive unit. At the same time, electric and/or hydraulic power is supplied to other components of the propulsion unit. The time period required for start-up of the propulsion unit allows the status of the steering system to be determined prior to operation of the vessel. During the diagnostic test, the auxiliary clutch is engaged, whereby operation of the main electric motor will simultaneously drive the auxiliary steering system. If the steering system comprises a main brake, then is disengaged as the auxiliary clutch is engaged.

Operation of the main electric motor during the test can involve rotating the propulsion unit from its default midship position, or other default position, into a first position to one side of the midship position, then into a second position to the other side of the midship position, and finally back to the midship position. A rotational displacement into at least one such position is performed during the test. According to one example, the propulsion unit can first be rotated from the midship position at 0° to an angle of +5°, second to an angle of −6°, and finally back to the midship position at 0°. These angles can be selected arbitrarily.

This rotational displacement of the propulsion unit during the diagnostic test allows an auxiliary angle sensor in the auxiliary steering system to be calibrated at the same time as the main electric motor, the main brake, and other electrical and mechanical components are checked. The auxiliary angle sensor is a one-turn sensor in the form of a potentiometer or a rotary encoder. During the diagnostic test, output values from the auxiliary angle sensor corresponding to the midship position and the at least one additional angular position are stored in an auxiliary control unit. The magnitude, or corresponding true angle, for each output value is known from the main control unit and/or the main angle sensor. Alternatively, magnitude, or corresponding true angle for each output value can be retrieved from the output signal of an encoder in the main electric motor, which encoder is connected to the main control unit. The stored output values can subsequently be used as reference values for calculating a required displacement of the auxiliary angle sensor for achieving a subsequently requested steering angle. In this way, multiple reference steering angles can be detected and stored as reference output values in the auxiliary control unit during the diagnostic test.

If the outcome of the diagnostic test is that the main steering system is operational, then the diagnostic test is completed. In this case, the auxiliary clutch is disengaged and steering is controlled by the main steering system. On the other hand, if a malfunction is detected and the main steering system is non-operational, then the diagnostic test cannot be completed. In that case, the auxiliary steering system takes over from the main steering system. This can be done either automatically or by manual selection of the operator.

According to a first example, a malfunction in the main steering system can be detected during the diagnostic test. In this example, the auxiliary clutch is maintained engaged and the main brake is maintained disengaged. Optionally, the main electric motor can be demagnetized when the auxiliary steering system takes over in order to further minimize friction losses.

An operator can steer the vessel from the main helm or by using an auxiliary helm, such as a rocker switch. In this way, a steering angle request can be transmitted to the auxiliary control unit. The auxiliary control unit uses the stored reference angle output values for determining the direction of the requested steering angle and for calculating the magnitude of an auxiliary angle sensor output value corresponding to the requested steering angle. The auxiliary control unit can then control the steering system and actuate the auxiliary electric motor to rotate the propulsion unit towards the requested steering angle. When the detected angle output value from the auxiliary angle sensor corresponds to the calculated angle sensor output value, then the requested steering angle has been achieved and the auxiliary electric motor is stopped.

In this first example, the auxiliary control unit assumes control when the propulsion unit is in its default midship position and the auxiliary angle sensor is in the reference position corresponding to 0°. An auxiliary angle sensor output signal representing the steering angle will then correspond to the true steering angle of the propulsion unit. The currently detected steering angle can be transmitted from the auxiliary control unit to, for instance, the main helm. If the auxiliary steering system is provided with an external mechanical indicator, then the mechanical indicator will automatically display the true steering angle of the propulsion unit.

According to a second example, a malfunction in the main steering system can be detected during operation of the vessel. Initially, a malfunction in the main steering system is detected by the main control system during operation and requires the auxiliary control system to take over. In this example, it is preferred to rotate the auxiliary angle sensor into an angular position corresponding to the current steering angle of the propulsion unit prior to engaging the auxiliary clutch.

In a first step, the auxiliary control unit calculates a required displacement of the auxiliary angle sensor for achieving a steering angle corresponding to the current steering angle. The current steering angle can be detected by the main angle sensor and/or an angle encoder in the main electric motor. The current steering angle is transmitted to the auxiliary control unit, which calculates the angle output value for the auxiliary angle sensor corresponding to the current steering angle of the propulsion unit using the stored reference angle output values. The auxiliary control unit then controls the auxiliary motor to rotate the auxiliary angle sensor into an angular position corresponding to the current steering angle of the propulsion unit. The auxiliary clutch is then engaged, and the main brake is maintained disengaged. The auxiliary control unit is then used for controlling the steering system and using the stored reference angle output values and a detected angle output value from the auxiliary angle sensor to calculate the corresponding steering angle of the propulsion unit. A requested steering angle received from the main or auxiliary helm can thus be converted to a corresponding angle output value for the auxiliary angle sensor. The auxiliary control unit can then control the steering system and actuate the auxiliary electric motor to rotate the propulsion unit towards the requested steering angle. When the detected angle output value from the auxiliary angle sensor corresponds to the calculated angle sensor output value, then the requested steering angle has been achieved and the auxiliary electric motor is stopped.

In this second example, the auxiliary control unit assumes control when the propulsion unit is in an arbitrary position and the auxiliary angle sensor is in the midship position, that is, the reference position corresponding to 0°. The auxiliary angle sensor must therefore be rotated so that the output signal representing the steering angle will correspond to the true steering angle of the propulsion unit. The currently detected steering angle can be transmitted from the auxiliary control unit to, for instance, the main helm.

According to an alternative second example, a malfunction in the main steering system is detected by the main control system during operation and requires an immediate actuation of the auxiliary control system. In this alternative example, the auxiliary clutch is engaged without considering a possible discrepancy between the current steering angle and the default midship position of the auxiliary angle sensor.

In a first step, the default output value of the auxiliary angle sensor is set equal to the steering angle of the propulsion unit at the time of engagement of the auxiliary clutch. As described above, the current steering angle can be detected and transmitted to the auxiliary control unit. The auxiliary control unit is then able to adjust subsequent calculations to take the initial difference between the current steering angle and the default midship position of the auxiliary angle sensor into consideration. The auxiliary control unit is then used for controlling the steering system and using the stored reference angle output values and a detected angle output value from the auxiliary angle sensor to calculate the corresponding steering angle of the propulsion unit. A requested steering angle received from the main or auxiliary helm can thus be converted to a corresponding angle output value for the auxiliary angle sensor. The auxiliary control unit can then control the steering system and actuate the auxiliary electric motor to rotate the propulsion unit towards the requested steering angle. When the detected angle output value from the auxiliary angle sensor corresponds to the calculated angle sensor output value, then the requested steering angle has been achieved and the auxiliary electric motor is stopped.

If the auxiliary steering system is provided with an external mechanical indicator, then the mechanical indicator can be provided with a bezel. When the vessel is travelling straight ahead, the operator can turn the bezel to match the position of the indicator with a datum position on the bezel to indicate an approximate midship position of the propulsion unit. In this way, the mechanical indicator can be compensated for an initial difference between the current steering angle and the default midship position of the auxiliary angle sensor In the above examples it has been assumed that a detected output value corresponding to a true steering angle for the propulsion unit is available from a main angle sensor in the main transmission and/or an angle encoder in the main electric motor. When the auxiliary steering system is in operation, a requested steering angle can be transmitted from an operator to the auxiliary control unit. A required displacement of the auxiliary angle sensor for achieving the requested steering angle is determined by the auxiliary control unit, based on stored auxiliary angle sensor output values representing a number of stored reference angles. The auxiliary electric motor is then controlled to steer the propulsion unit to the steering angle requested by the operator.

The examples given above are substantially directed to an azimuthing inboard performance system (IPS) or a similar steerable propulsion unit. However, the invention is also applicable to other propulsion systems, as will be described in connection with the attached drawing figures.

According to a second aspect of the invention, the object is achieved by an electrical steering system in a marine vessel as described above.

The steering system comprises a main steering system that comprises a main electric motor and a main power source, for instance a main battery, providing electrical power to the first electric motor for steering control. A main brake can be arranged adjacent the main electric motor and is controllable allow or prevent rotation of the main electric motor and an input shaft of a steering transmission used for steering the propulsion unit. A main control unit is arranged to steer the propulsion unit in response to an input from an operator and to monitor the main steering system status. The main control unit can be arranged to steer the propulsion unit in response to an input from a main helm.

The steering system further comprises an auxiliary steering system comprising an auxiliary electric motor and an auxiliary battery providing electrical power to the second electric motor. An auxiliary clutch arranged to connect a drive shaft of the auxiliary electric motor to the input shaft of the transmission in order to steer the propulsion unit. The auxiliary steering system preferably comprises an auxiliary control unit arranged to control the steering of the propulsion unit in response to an input from an operator. The auxiliary control unit can be arranged to steer the propulsion unit in response to an input from the main helm. Alternatively, the auxiliary steering system comprises an auxiliary helm arranged to steer the propulsion unit in response to an input from an operator. The auxiliary helm can comprise a rocker switch that can, for instance, be mounted in the vicinity of the main helm or in the engine compartment. The rocker switch can, for instance, be spring loaded to a neutral position.

The auxiliary control unit can comprise a printed circuit board (PCB) that mechanically supports and electrically connects electronic components or electrical components. The PCB comprises some logic functions and a memory function. Power supply is provided from the auxiliary battery. The PCB also controls the auxiliary steering system in response to input from the main and/or the auxiliary helm.

The auxiliary electric motor can be connected to a visible mechanical indicator indicating a true steering angle. The indicator can be mounted on the housing containing the auxiliary steering system. In order to convert the rotary motion of the auxiliary electric motor to a one-turn motion suitable for a dial, the motor is connected to the mechanical indicator via an auxiliary transmission, such as a planetary transmission. The gear ratio of the auxiliary transmission is selected so that it converts the total number of turns required by the electric motors to steer the propulsion unit from one end position to the other into one single turn (360°). The gear ratio of the auxiliary transmission is dependent on the gear ratio of the main transmission and the maximum steering angles for the end positions of the propulsion unit. For instance, if the main electric motor requires 150 revolutions for rotating the propulsion unit between its end positions, then the auxiliary transmission can be given a gear ratio of 1:150. The output shaft of the auxiliary transmission will then move one turn when the propulsion unit is rotated between its end positions.

If the auxiliary steering system is provided with an external mechanical indicator, then the mechanical indicator can be provided with a bezel. For instance, when the vessel is travelling straight ahead and the indicator does not coincide with the midship position at 0° on a scale indicating the steering angle, the operator can turn the bezel to match the position of the indicator with a datum position on the bezel to indicate an approximate midship position of the propulsion unit. In this way, the mechanical indicator can be compensated for an initial difference between the current steering angle and the default midship position of the auxiliary angle sensor at the time of actuation of the auxiliary clutch.

The auxiliary control unit can be arranged to detect and store a reference steering angle corresponding to a midship position, or another predetermined default position, during start-up of the drive unit of the propulsion unit. The auxiliary control unit can use an auxiliary angle sensor in the form of a one revolution/turn potentiometer or a similar suitable shaft rotation sensor to detect and monitor the steering angle. The shaft rotation sensor can be arranged at the output shaft of the auxiliary transmission and is connected to the PCB.

A start-up of the drive unit can involve cranking an internal combustion engine or powering up the power electronic circuits of an electric drive unit. During start-up the main control unit can perform a diagnostic test of the main steering system to determine its status and whether it is operational. During the diagnostic test, the auxiliary clutch is engaged. When the steering system comprises a main brake, this is disengaged as the auxiliary clutch is engaged. During the test, a calibration of the auxiliary angle sensor is performed. During the calibration, the main electric motor is operated to move the propulsion unit from a default midship position, into one or more arbitrary positions and back to the midship position. This allows the auxiliary angle sensor to detect and store the midship position and at least one further position as reference steering angles, in case the main control unit determines that the main steering system is non-operational. If this part of the diagnostic test cannot be performed, previously stored values for the reference angles are used. When the diagnostic test is performed successfully, the auxiliary clutch is disengaged and normal operation or the steering system is resumed.

While the main steering system is operational, a signal indicating the steering angle is transmitted from the main angle sensor to the main control unit and a display at the main helm in order to inform the operator of the current steering angle. When the main steering system is non-operational, the auxiliary steering system takes over and the steering angle is instead indicated by the mechanical indicator and/or by a signal from the auxiliary angle sensor to the main helm. Alternatively, or in addition, a signal indicating the steering angle can be transmitted from the auxiliary control unit to a display adjacent the main helm.

According to one example, the output shaft of the auxiliary clutch can be mechanically connected directly to the drive shaft of the main electric motor. If the drive shaft of the main electric motor is arranged in a vertical direction and supported in a bearing in a main steering system housing, then a housing containing the auxiliary electric motor can be mounted directly on top of the housing of the main electric motor. In this case, the drive shafts of the main electric motor and the auxiliary electric motor are coaxial. This allows the auxiliary steering system to be retrofitted onto an existing main steering system.

According to an alternative example, the output shaft of the auxiliary clutch can be mechanically connected to the drive shaft of the main electric motor via a suitable gearing, such as an angular gear or a bevel gear. In this way, the housing containing the auxiliary electric motor can be mounted onto the housing of the main electric motor at any suitable angle, for instance with the drive shaft of the auxiliary electric motor arranged horizontally. The location of the auxiliary steering system relative to the main steering system can be determined by the available space adjacent the steerable propulsion unit.

According to a third aspect of the invention, the object is achieved by a marine vessel with at least one steerable propulsion unit comprising an electrical steering system as described above.

An advantage of an electrical steering system according to the invention is that it provides a reliable and compact steering arrangement for both single and multiple installation propulsion units, where one or more additional propulsion units are not available as a redundant steering means. For installations comprising multiple propulsion units, the system would provide limp-home functionality, while reducing system complexity and space requirements for an alternative back-up system. The auxiliary steering system according to the invention can be mounted onto an existing electrical steering system without requiring substantial modification and can be made fully independent of the main steering system. In addition to being provided with its own electrical supply, the auxiliary steering system comprises a back-up steering angle sensor, which in turn can be backed up by a mechanical steering angle indicator in case of an electronical failure in the auxiliary steering system. An additional advantage is that the auxiliary steering system allows the vessel to be controllable from multiple positions, depending on the degree of systems failure. In this way the electrical steering system can be made reliable as it comprises several levels of back-up options.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1A:
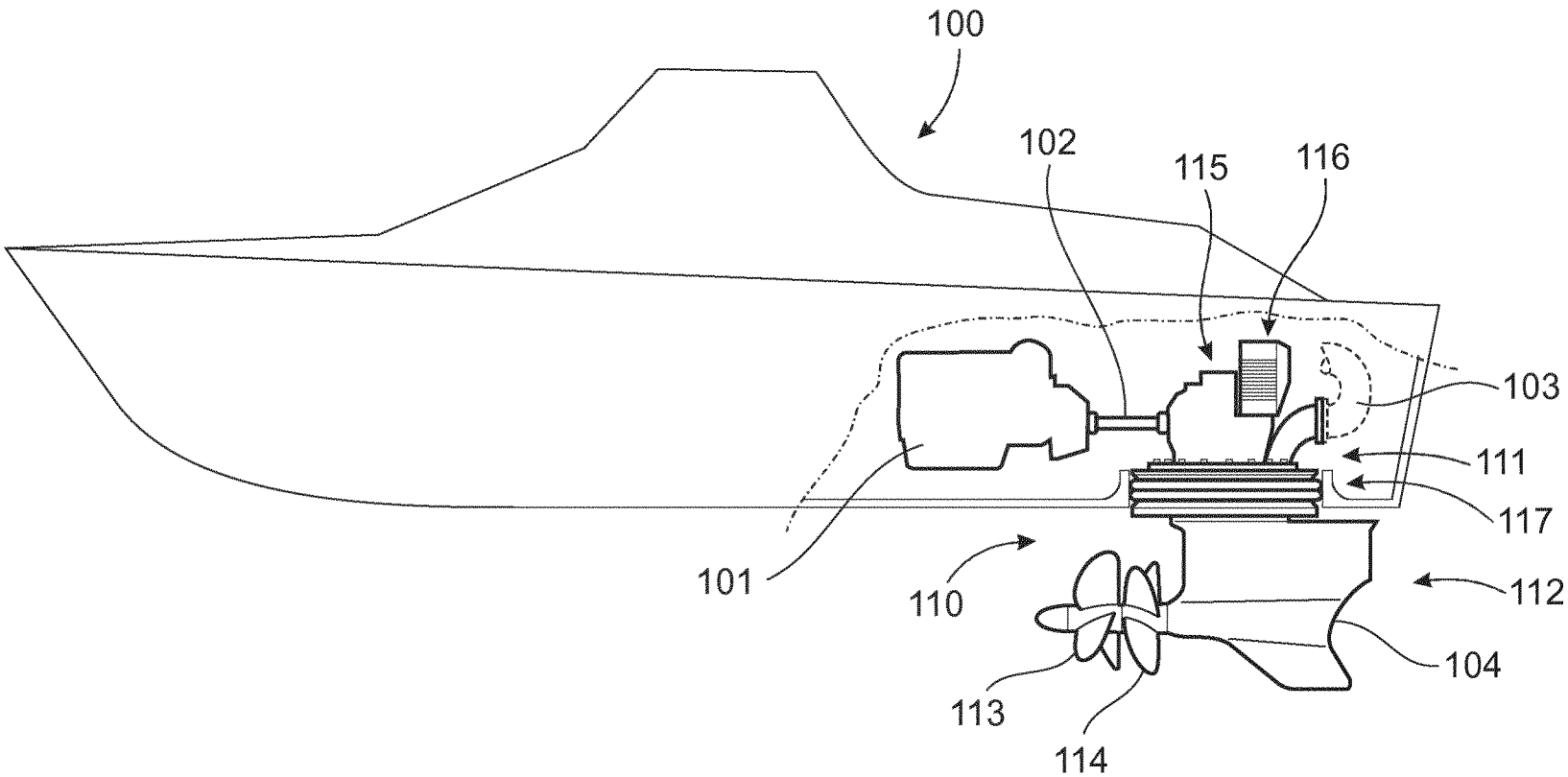
FIGS. 1A-C show schematically illustrated vessels comprising electrical steering systems according to the invention.

FIG. 1A shows a schematically illustrated vessel 100 comprising an electrical steering system according to the invention. The vessel 100 comprises a drive unit 101 connected to an inboard performance system (IPS) 110 via a drive shaft 102. In this example the drive unit 101 is an internal combustion engine, wherein an exhaust conduit (not shown) from the drive unit 101 enters an exhaust inlet 103 on a fixed upper portion 111 of the IPS 110. Exhaust gas passes through the IPS 110 and exits below the surface of the water through an exhaust port 104 at the rear end of a steerable lower portion 112 of the IPS 110. The lower portion 112 in this example is a steerable pod with counter rotating forward-facing propellers 113, 114, which are operated from a main helm (see FIG. 2A) by a suitable throttle controller, such as a joystick or a lever. The upper portion 111 of the IPS 110 comprises a transmission 115 transferring torque from the drive shaft 102 to a pair of coaxial propeller shafts via an intermediate shaft (not shown) passing through the axis of rotation of the steerable lower portion 112. The upper portion 111 of the IPS 110 further comprises an electrical steering system 116 that can be operated from a main helm (see FIG. 2A) by a suitable steering controller, such as a joystick or a rotatable wheel. An electrical motor (see FIG. 2A) drives a transmission that causes rotation of the lower portion 112. The fixed upper portion 111 and the steerable lower portion 112 are joined adjacent the hull of the vessel and are provided with a water tight seal 117 that allows for relative rotation of the two portions.

Figure 2A:
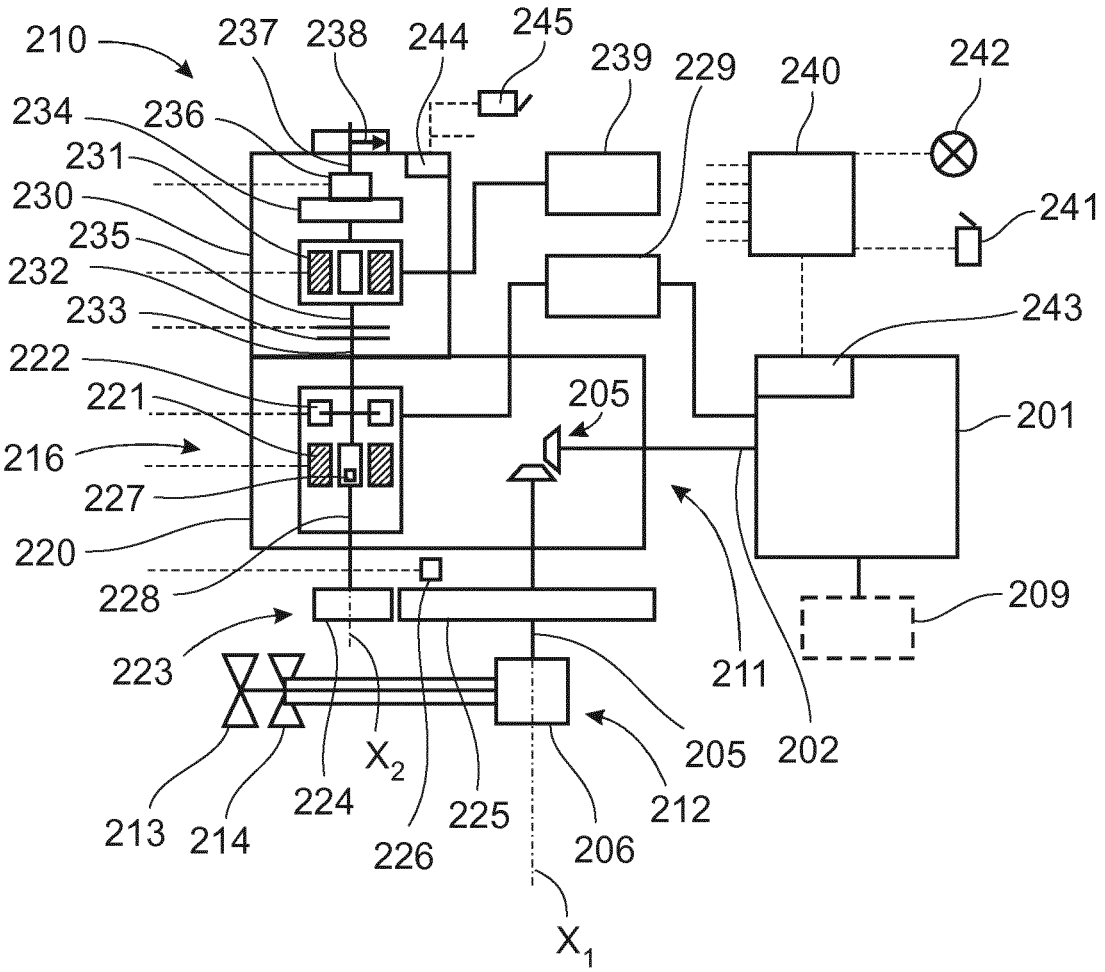
FIGS. 2A-B show schematic illustrations of auxiliary steering systems according to the invention connected to a main steering system.

FIG. 2A shows a schematic illustration of an electrical steering system 216 comprising a main steering system 220 and an auxiliary steering system 230. The electrical steering system 216 is part of an inboard performance system (IPS) 210 comprising a fixed upper portion 211 and a steerable lower portion 212 as indicated in FIG. 1A. FIG. 2A further shows a drive unit 201 connected to the upper portion 211 of the IPS 210 via a drive shaft 202. The upper portion 211 comprises a transmission 215 indicated by bevel gears for transmitting torque via an intermediate vertical shaft 205 into the lower portion 212 of the IPS 210. The lower portion 212 is rotatable about the axis X of the vertical shaft 205. A further transmission 206 transmits torque to a pair of counter-rotating forward-facing propellers 213, 214. The lower portion 212 in this example is a steerable pod with counter rotating forward-facing propellers 213, 214 operated from a main helm by a throttle controller 241, such as a joystick or a lever.

The main steering system 220 located in the upper portion 211 of the IPS 210 can be operated from the main helm by a steering controller 242, such as a joystick or a rotatable wheel. In this example, the main steering system 220 comprises a main electric motor 221 and a controllable main brake 222. The main brake 222 can be spring loaded into an engaged state by and can be switched to a disengaged state by means of a solenoid. When engaged, the main brake 222 prevents rotation of the main electric motor 221 and an input shaft 228 of a steering transmission 223 that causes rotation of the lower portion 212, in order to lock the propulsion unit in position. When the vessel is being operated and/or in response to a steering command, the main brake 222 is disengaged. The steering transmission 223 comprises at least one pinion gear 224 driving a ring gear 225 fixed to the lower portion 212 and centred about the axis X of the vertical shaft 205. A position sensor 226, such as a resolver or encoder, is provided to detect the position of the ring gear 225 and thereby the steering angle of the lower portion 212. This angle is also referred to as the steering angle of the propulsion unit. The main steering system 220 is connected to a main power source in the form of a main battery 229. The main battery 229 can be a part of the main power supply of the vessel or be a separate battery used only by the main steering system 220. In the latter case, the drive unit can be cranked by a starter battery 209 (shown in dashed lines).

The auxiliary steering system 230 is located adjacent the main steering system 220 in the upper portion 211 of the IPS 210. The auxiliary steering system 230 comprises an auxiliary electric motor 231 and a controllable auxiliary clutch 232 The auxiliary clutch 232 is normally disengaged an connects the auxiliary electric motor 231 to the steering transmission 223 that causes rotation of the lower portion 212. In the example in FIG. 2A, the auxiliary clutch 232 has an output shaft 233 that is coaxial with the drive shaft of the main electric motor 221. In this way, the output shaft 233 of the auxiliary clutch 232 is drivingly connected to the drive shaft of the main electric motor 221 and to the main brake 222. When engaged, the auxiliary clutch 232 connects the auxiliary electric motor 231 to the pinion gear 224 for driving the ring gear 225 fixed to the lower portion 212. On the opposite side of the auxiliary electric motor 231 from the auxiliary clutch 232, the drive shaft 235 of the auxiliary electric motor 231 is connected to a planetary transmission 234. The gear ratio of the planetary transmission 234 is sufficient to convert the rotation of the auxiliary electric motor 231 to a rotation corresponding to the rotation of the propulsion unit. A position sensor 236, such as a one-turn potentiometer is arranged at the output shaft 237 of the planetary transmission 234 to detect the angular position of the output shaft 237. Finally, the output shaft 237 is connected to a mechanical indicator 238, such as a dial mounted on the outer housing of the auxiliary steering system 230. The mechanical indicator 238 shows the current steering angle of the propulsion unit. The auxiliary steering system 230 is connected to a power supply in the form of an auxiliary battery 239. The auxiliary battery 239 is used as a back-up source of power if a failure occurs in the main power source.

The main steering system 220 is controlled by a main control unit, or helm control unit (HCU) 240. The HCU 240 receives a steering angle request from the steering controller 242 at the main helm and transmits a control signal to the main steering system 220 to drive the main electric motor 221. The main electric motor 221 is operated to drive the pinion gear 224 and the ring gear 225 fixed to the lower portion 212. The position sensor 226 detects the position of the ring gear 225 and transmits the current steering angle of the lower portion 212 back to the HCU 240. The main electric motor 221 is stopped when the requested steering angle is reached. The HCU 240 is also connected to an engine control unit (ECU) 243 on the drive unit 201. The HCU 240 receives a throttle request from the throttle controller 241 at the main helm and transmits a control signal to the ECU 243, which output a requested output torque to the counter rotating forward-facing propellers 213, 214. The main steering system 220 located in the upper portion 211 of the IPS 210 can be operated from the main helm by a steering controller 242, such as a joystick or a rotatable wheel. According to an alternative example, throttle and steering control can be performed by a single controller (not shown) in the form of a joystick. In FIG. 2A, dashed lines indicate wiring, wire harnesses or CAN buses for control signals or sensor signals. In general, wiring from the main steering system 220 is connected to the main control unit 240, while wiring from the auxiliary steering system 230 is connected to the auxiliary control unit 244. In addition, the auxiliary control unit 244 is connected to the main control unit 240 in order to allow sharing of data relating to steering requests, detected steering angles and other related data between the main and auxiliary systems.

The auxiliary steering system 230 can be controlled by the HCU 240 or by an auxiliary control unit 244 in the auxiliary steering system 230, when a malfunction is detected in the main steering system 220. The auxiliary controller 245 can be located at the main helm, in the engine compartment on or adjacent the electrical steering system 230, or in an alternative suitable position. The auxiliary control unit 245 can be a printed circuit board (PCB) that comprises some logic functions and a memory function for storing data in case of a power failure. Power supply is provided from the auxiliary battery 239. The PCB controls the auxiliary steering system 230 in response to input from the steering controller 242 at the main helm and/or the auxiliary controller 245.

When a malfunction is detected in the main steering system 220, the HCU 240 will transmit a control signal to close the auxiliary clutch 232. The main brake 222 is maintained open to allow steering to be performed. If the main helm is used, the HCU 240 receives a steering angle request from the steering controller 242 at the main helm. In response to the steering angle request, the auxiliary control unit 244 in the auxiliary steering system 230 actuates the auxiliary electric motor 231. The auxiliary electric motor 231 is operated to drive the pinion gear 224 and the ring gear 225 fixed to the lower portion 212. The position sensor 226 detects the position of the ring gear 225 and transmits the current steering angle of the lower portion 212 back to the HCU 240. The auxiliary electric motor 231 is automatically stopped when the requested steering angle is reached.

If the auxiliary controller 245 is used, the auxiliary control unit 244 receives a steering angle request from the controller and transmits a control signal to drive the auxiliary electric motor 231. The position sensor 236 in the auxiliary steering system 230 detects the position of the output shaft 237 of the planetary transmission 234 and transmits the current steering angle of the lower portion 212 back to the auxiliary control unit 244 and the HCU 240. Alternatively, magnitude, or corresponding true angle can be retrieved from the output signal of an encoder 227 in the main electric motor, which encoder is connected to the HCU 240. The position sensor 226 on the ring gear 225 can also be used for this purpose. The position sensors can be used for back-up in case one sensor has failed.

Depending on the location of the auxiliary controller 245, the operator can monitor the current steering angle on the mechanical indicator 238 or on a display at the main helm. The operator manually stops the auxiliary electric motor 231 when the requested steering angle is reached.

Figure 1B:
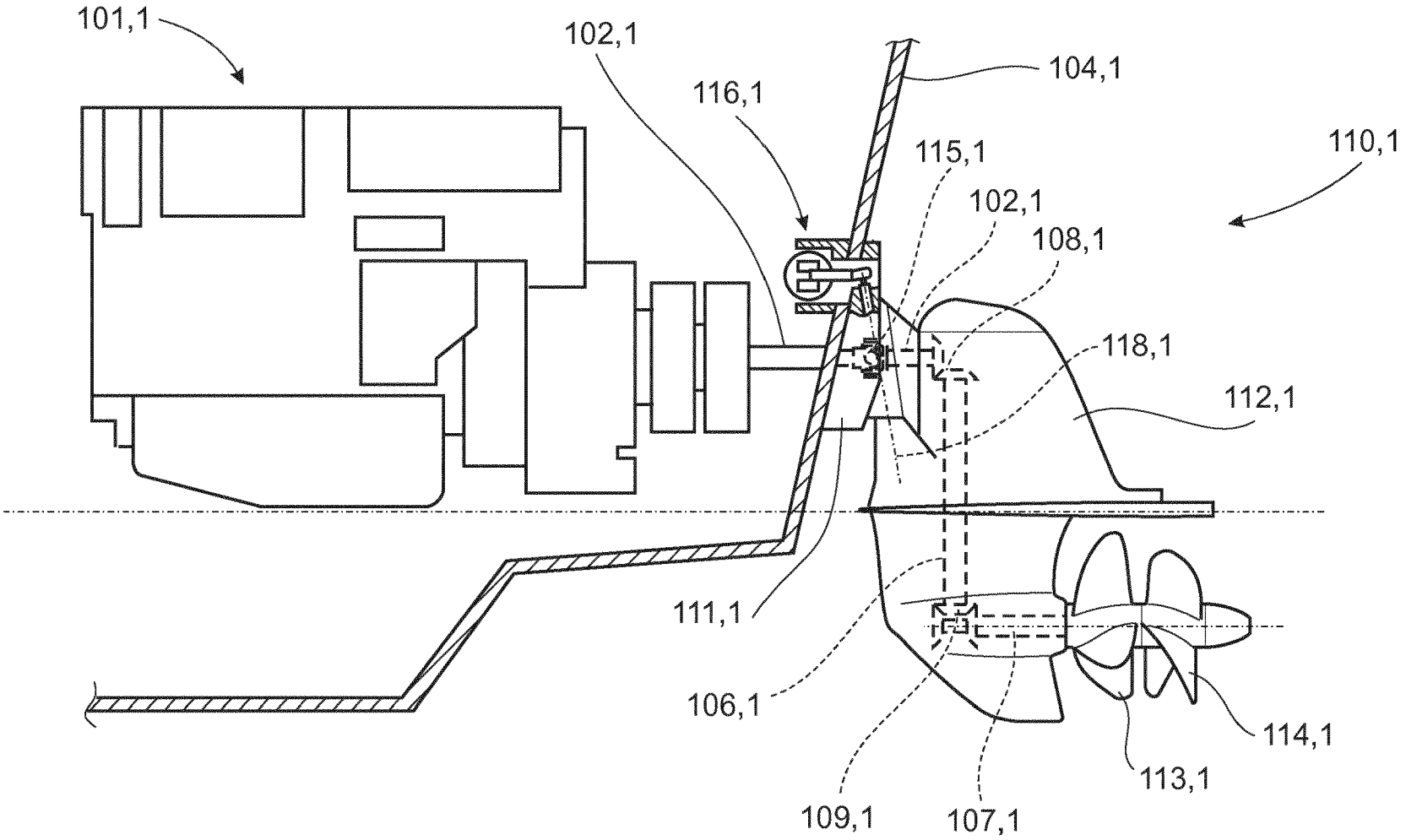
Figure 1C:
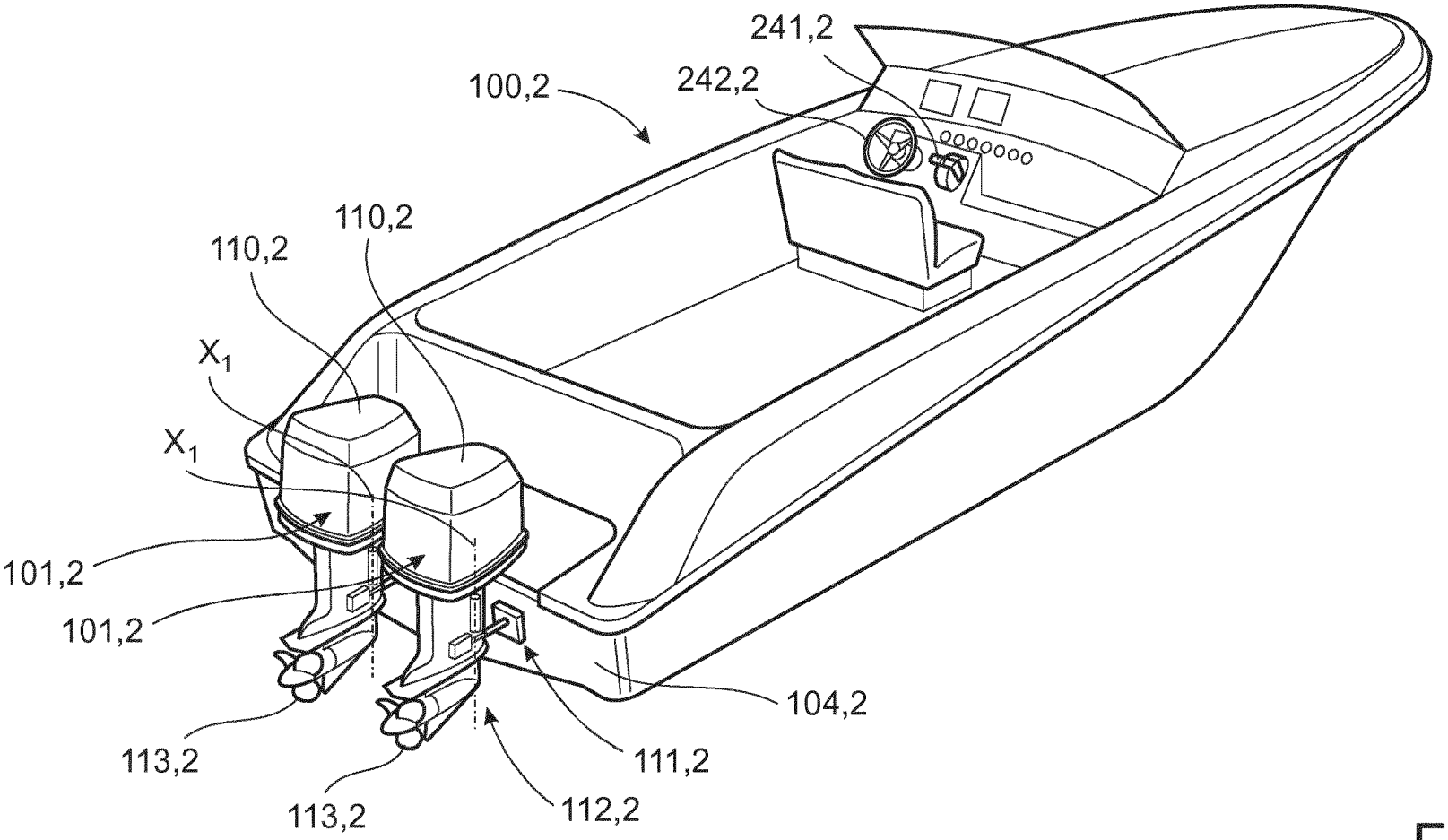

FIG. 1B shows a schematically illustrated vessel 100.1 comprising an electrical steering system according to a first alternative embodiment of the invention. The vessel 100.1 comprises a drive unit 101.1 connected to a stern drive 110.1 via a drive shaft 102.1. In this example the drive unit 101.1 is an internal combustion engine mounted within the hull of the vessel 100.1. The stern drive 110.1 comprises a fixed outer portion 111.1, attached to a transom 104.1 at the rear of the vessel, and a steerable outer portion 112.1 attached to the fixed outer portion 111.1 via a pivot 118.1. The steerable outer portion 112.1 in this example is a steerable propulsion unit with counter rotating rearward-facing propellers 113.1, 114, which are operated from a main helm (not shown) by a suitable throttle controller, such as a joystick or a lever. The fixed outer portion 111.1 of the stern drive 110.1 supports a transmission 115.1 connected to the drive shaft 102.1. The transmission 115.1 comprises a universal joint, which is in turn connected to a bevel gear for driving the intermediate shaft 106.1. The transmission 115.1 allows torque to be transferred from the drive shaft 102.1 to a pair of coaxial propeller shafts 107.1 via an intermediate shaft 106.1 and a pair of bevel gears 108.1, 109.1 in the steerable outer portion 112.1. The axis of rotation of the steerable outer portion 112.1 passes through the universal joint, allowing the steerable outer portion 112.1 to be rotated, for instance, +1-30° relative to the longitudinal axis of the vessel. The stern drive 110.1 further comprises an electrical steering system 116.1 that can be operated from a main helm (not shown) by a suitable steering controller, such as a joystick or a rotatable wheel. An electrical motor (see FIG. 2B) drives a steering transmission that causes rotation of the steerable outer portion 112.1. The fixed outer portion 111.1 and the steerable outer portion 112.1 are joined by a pivoting mechanism that allows for relative rotation of the two portions.

Figure 2B:
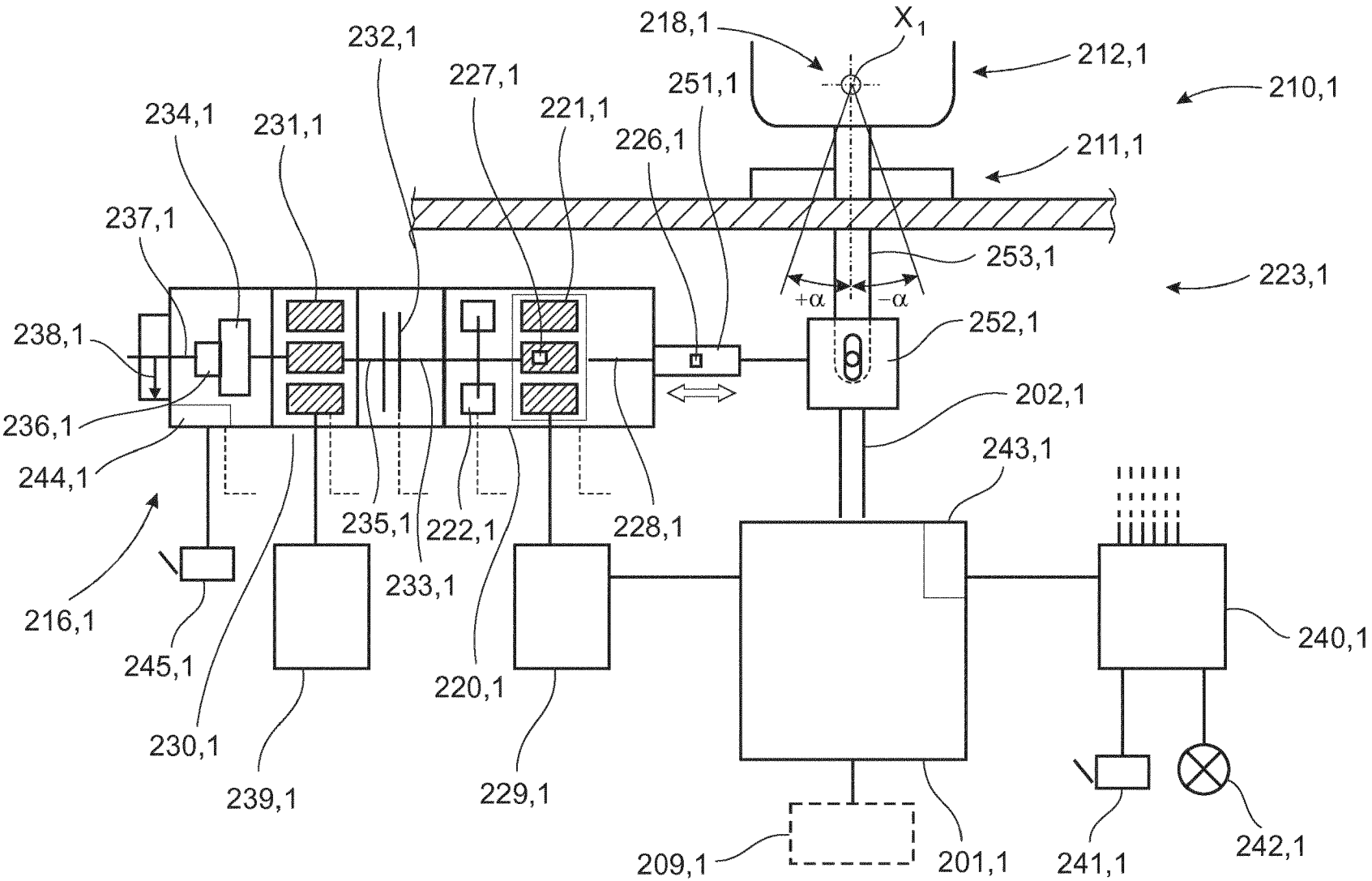

FIG. 2B shows a schematic illustration of an electrical steering system 216.1 comprising a main steering system 220.1 and an auxiliary steering system 230.1. The electrical steering system 216.1 is connected to a stern drive 210.1 comprising a fixed outer portion 211.1 and a steerable outer portion 212.1 as indicated in FIG. 1B. FIG. 2B further shows a drive unit 201.1 connected to the fixed outer portion 211.1 of the stern drive 210.1 via a drive shaft 202.1. The fixed outer portion 211.1 comprises a transmission (see FIG. 1B) for transmitting torque via an intermediate vertical shaft in the steerable outer portion 212.1 of the stern drive 210.1. The steerable outer portion 212.1 is rotatable about the axis X1 of a substantially vertical pivot 218.1 attached to the fixed outer portion 211.1. The steerable outer portion 212.1 in this example is a steerable propulsion unit with counter rotating forward-facing propellers operated from a main helm by a throttle controller, such as a joystick or a lever.

The main steering system 220.1 is located adjacent the fixed outer portion 211.1 of the stern drive 210.1 and can be operated from the main helm by a steering controller 242.1, such as a joystick or a rotatable wheel. In this example, the main steering system 220.1 comprises a main electric motor 221.1 and a controllable main brake 222.1. The main brake 222.1 can be spring loaded into an engaged state by and can be switched to a disengaged state by means of a solenoid. When engaged, the main brake 222.1 prevents rotation of the main electric motor 221.1 and an input shaft 228.1 of a steering transmission 223.1 that causes rotation of the steerable outer portion 212.1, in order to lock the propulsion unit in position. When the vessel is being operated and/or in response to a steering command, the main brake 222.1 is disengaged. In this example, the steering transmission 223.1 comprises a ball screw arrangement 251.1 that converts the rotary motion of the main electric motor 221.1 into a linear displacement of an arm connected to a lever 253.1 attached to the steerable outer portion 212.1. The ball screw arrangement 251.1 acts on a connecting piece 252.1 that is operatively connected to a guide pin at the free end of the lever 253.1, attaching it to the steerable outer portion 212.1. In this way, rotation of the main electric motor 221.1 causes a linear extension of the ball screw arrangement 251.1. This causes a displacement of the lever 253.1, which in turn causes the steerable outer portion 212.1 to be rotated an angle $\alpha$ about the pivot 218.1.

A suitable position sensor 226.1, such as a Hall sensor, resolver or encoder, is provided to detect the position, and thereby the linear extension, of the ball screw arrangement 251.1. This allows the steering angle $\alpha$ of the steerable outer portion 212.1 to be determined. This angle is also referred to as the steering angle $\alpha$ of the propulsion unit and is indicated as a positive or negative angle relative to a datum line, which datum line coincides with the longitudinal axis of the vessel. The main steering system 220.1 is connected to a main power source in the form of a main battery 229.1. The main battery 229.1 can be a part of the main power supply of the vessel or be a separate battery used only by the main steering system 220.1. In the latter case, the drive unit can be cranked by a starter battery 209.1 (shown in dashed lines).

The auxiliary steering system 230.1 is located adjacent the main steering system 220.1 near the fixed outer portion 211.1 of the stern drive 210.1. The auxiliary steering system 230.1 comprises an auxiliary electric motor 231.1 and a controllable auxiliary clutch 232.1 The auxiliary clutch 232.1 is normally disengaged an connects the auxiliary electric motor 231.1 to the steering transmission 223.1 that causes rotation of the steerable outer portion 212.1. In the example in FIG. 2B, the auxiliary clutch 232.1 has an output shaft 233.1 that is coaxial with the drive shaft of the main electric motor 221.1. In this way, the output shaft 233.1 of the auxiliary clutch 232.1 is drivingly connected to the drive shaft of the main electric motor 221.1 and to the main brake 222.1. When engaged, the auxiliary clutch 232.1 connects the auxiliary electric motor 231.1 to the pinion gear 224.1 for driving the ring gear 225.1 fixed to the steerable outer portion 212.1. On the opposite side of the auxiliary electric motor 231.1 from the auxiliary clutch 232.1, the drive shaft 235.1 of the auxiliary electric motor 231.1 is connected to a planetary transmission 234.1. The gear ratio of the planetary transmission 234.1 is sufficient to convert the rotation of the auxiliary electric motor 231.1 to a rotation corresponding to the rotation of the propulsion unit. A position sensor 236.1, such as a one-turn potentiometer is arranged at an output shaft 237.1 of the planetary transmission 234.1 to detect the angular position of the output shaft 237.1. Finally, the output shaft 237.1 is connected to a mechanical indicator 238.1, such as a dial mounted on the outer housing of the auxiliary steering system 230.1. The mechanical indicator 238.1 shows the current steering angle of the propulsion unit. The auxiliary steering system 230.1 is connected to a power supply in the form of an auxiliary battery 239.1. The auxiliary battery 239.1 is used as a back-up source of power if a failure occurs in the main power source.

The main steering system 220.1 is controlled by a main control unit, or helm control unit (HCU) 240.1. The HCU 240.1 receives a steering angle request from the steering controller 242.1 at the main helm and transmits a control signal to the main steering system 220.1 to drive the main electric motor 221.1. The main electric motor 221.1 is operated to drive the ball screw arrangement 251.1 drivingly connected to the steerable outer portion 212.1. The position sensor 226.1 detects the position of the ball screw arrangement 251.1 and transmits the current steering angle of the steerable outer portion 212.1 back to the HCU 240.1. The main electric motor 221.1 is stopped when the requested steering angle $\alpha$ is reached. The HCU 240.1 is also connected to an engine control unit (ECU) 243.1 on the drive unit 201.1. The HCU 240.1 receives a throttle request from the throttle controller 241.1 at the main helm and transmits a control signal to the ECU 243.1, which output a requested output torque to the counter rotating rearward-facing propellers. The main steering system 220.1 located near the fixed outer portion 211.1 of the stern drive 210.1 can be operated from the main helm by a steering controller 242.1, such as a joystick or a rotatable wheel. According to an alternative example, throttle and steering control can be performed by a single controller (not shown) in the form of a joystick. In FIG. 2B, dashed lines indicate wiring, wire harnesses or CAN buses for control signals or sensor signals. In general, wiring from the main steering system 220.1 is connected to the main control unit 240.1, while wiring from the auxiliary steering system 230.1 is connected to the auxiliary control unit 244.1. In addition, the auxiliary control unit 244.1 is connected to the main control unit 240.1 in order to allow sharing of data relating to steering requests, detected steering angles and other related data between the main and auxiliary systems.

The auxiliary steering system 230.1 can be controlled by the HCU 240.1 or by an auxiliary control unit 244.1 in the auxiliary steering system 230.1, when a malfunction is detected in the main steering system 220.1. The auxiliary controller 245.1 can be located at the main helm, in the engine compartment on or adjacent the electrical steering system 230.1, or in an alternative suitable position. The auxiliary control unit 245.1 can be a printed circuit board (PCB) that comprises some logic functions and a memory function for storing data in case of a power failure. Power supply is provided from the auxiliary battery 239.1. The PCB controls the auxiliary steering system 230.1 in response to input from the steering controller 242.1 at the main helm and/or the auxiliary controller 245.1.

When a malfunction is detected in the main steering system 220.1, the HCU 240.1 will transmit a control signal to close the auxiliary clutch 232.1. The main brake 222.1 is maintained open to allow steering to be performed. If the main helm is used, the HCU 240.1 receives a steering angle request from the steering controller 242.1 at the main helm. In response to the steering angle request, the auxiliary control unit 244.1 in the auxiliary steering system 230.1 actuates the auxiliary electric motor 231.1. The auxiliary electric motor 231.1 is operated to drive the ball screw arrangement 251.1 and the lever 253.1 fixed to the steerable outer portion 212.1. The position sensor 226.1 detects the position of the ball screw arrangement 251.1 and transmits the current steering angle of the steerable outer portion 212.1 back to the HCU 240.1. The auxiliary electric motor 231.1 is automatically stopped when the requested steering angle is reached.

If the auxiliary controller 245.1 is used, the auxiliary control unit 244.1 receives a steering angle request from the controller and transmits a control signal to drive the auxiliary electric motor 231.1. The position sensor 236.1 in the auxiliary steering system 230.1 detects the position of the output shaft 237.1 of the planetary transmission 234.1 and transmits the current steering angle of the steerable outer portion 212.1 back to the auxiliary control unit 244.1 and the HCU 240.1. Alternatively, magnitude, or corresponding true angle can be retrieved from the output signal of an encoder 227.1 in the main electric motor, which encoder is connected to the HCU 240.1. The position sensor 226.1 on the ball screw arrangement 251.1 can also be used for this purpose. The position sensors can be used for back-up in case one sensor has failed.

Depending on the location of the auxiliary controller 245.1, the operator can monitor the current steering angle on the mechanical indicator 238.1 or on a display at the main helm. The operator manually stops the auxiliary electric motor 231.1 when the requested steering angle is reached.

FIG. 10 shows a schematically illustrated vessel 100.2 comprising an electrical steering system according to a second alternative embodiment of the invention. The vessel 100.2 comprises a pair of drive unit 101.2 in the form of outboard engines 110.2 mounted to the transom 104.2 at the rear of the vessel 100.2. The outboard engines 110.2 each comprises a fixed portion 111.2, attached to the transom 104.2, and a steerable portion 112.2 attached to the fixed portion 111.2 via a pivot, indicated by the respective axes X1. This arrangement allows the steerable portion 112.2 to be rotated, for instance, +/−30° relative to the longitudinal axis of the vessel about said pivot. In this example the drive units 101.2 are internal combustion engines, wherein an exhaust conduit (not shown) from the drive unit 101.2 passes through the vertical stems of the outboard engines 110.2 and exits below the surface of the water through a pair of rearward-facing propellers 113.2 operated from a main helm 242.2 by a suitable throttle controller, such as a joystick or a lever. The transmission transferring torque from the drive units 101.2 to the propeller shafts in outboard engines is well known in the art and will not be described in further detail.

At least one of the outboard engines 110.2 further comprises an electrical steering system (not shown) that can be operated from a main helm 242.2 by a suitable steering controller, such as a joystick or a rotatable wheel. The schematically illustrated electrical steering system shown in FIG. 2B can be applied to the drive units of the vessel in FIG. 10 and be used for steering at least one of the outboard engines 110.2.

In the case of outboard engines, an alternative arrangement of an electrical steering system can involve mounting a main and an auxiliary electrical motor, with their associated transmission components, within the drive unit itself. According to one example, the electrical motors could be placed in line with the pivot connecting the steerable portion 112.2 and the fixed portion 111.2.

Figure 3:
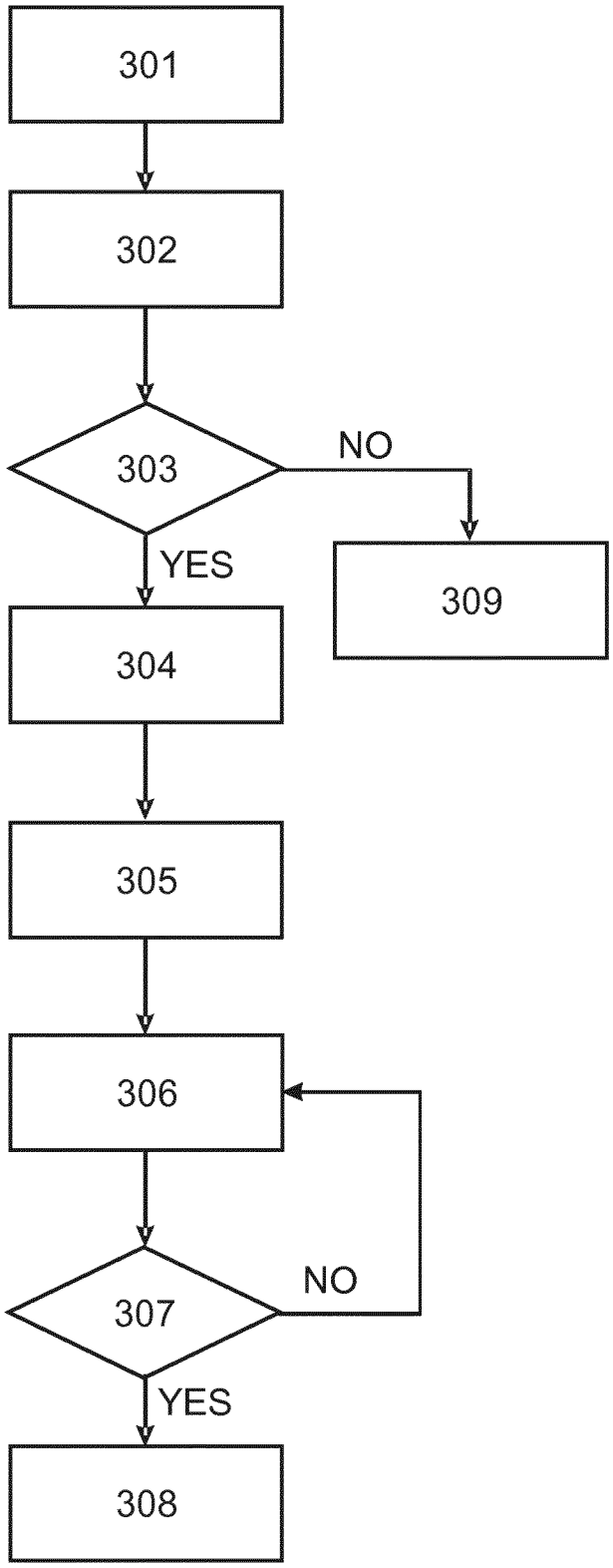
FIG. 3 shows a schematic diagram illustrating the operation of the steering system according to the invention.

FIG. 3 shows a schematic diagram illustrating the steps performed during operation of the steering system in a marine vessel comprising a steerable propulsion unit in response to a detected failure in the main steering system. In operation, the process for operating the electrical steering system as described above involves the following steps. The process is described with reference to the components indicated by reference numerals in FIG. 2A.

In a first step 301 a start-up of the drive unit is detected. A start-up can involve cranking an internal combustion engine or powering up the power electronic circuits of an electric drive unit operated by a high voltage battery pack. The start-up period may take up to a few seconds.

In a second step 302, the main control unit performs a diagnostic test of the main steering system during the start-up period to determine its status and whether it is operational. During the diagnostic test, the main brake is disengaged, and the auxiliary clutch is engaged. During the test, the main electric motor is operated to move the propulsion unit from its default midship position into a first position to one side of the midship position, then into a second position to the other side of the midship position, and finally back to the midship position. This allows the auxiliary angle sensor in the auxiliary steering system to detect the midship position and at least one further position as reference steering angles. The sensor signals representing angular positions are transmitted to the auxiliary control unit.

The auxiliary control unit 244 can be a printed circuit board (PCB) and is arranged to store the reference steering angles corresponding to a midship position during start-up of the drive unit of the propulsion unit while the diagnostic test is being performed. The PCB 244 can use the auxiliary angle sensor in the auxiliary steering unit 230 to detect and monitor the steering angle. This shaft rotation sensor can be arranged at the output shaft of the auxiliary transmission and is connected to the PCB, which stores the midship position as a reference angle. If, for any reason, this part of the diagnostic test cannot be performed, a previously stored value in the PCB for the reference angle can be used. The result of the diagnostic test is evaluated in the subsequent step.

In a third step 303, the main control unit determines whether the diagnostic test has been completed and if the main steering system is operational or not. If the main steering system is deemed operational at the end of the diagnostic test, then the process proceeds to step 309. In this step, the main brake and the auxiliary clutch are disengaged, and normal operation of the main steering system is resumed. A signal indicating the steering angle is transmitted from the main angle sensor to the main control unit and a display at the main helm in order to inform the operator of the current steering angle. The operator can then control the main steering system from the main helm.

However, if the main steering system is deemed non-operational at the end of the diagnostic test, then the process proceeds to a fourth step 304 and initiates operation of the auxiliary steering system 230. In the fourth step 304, the main brake is maintained disengaged and the auxiliary clutch is engaged. The main steering system is thereby disconnected from the steering transmission and the steerable propulsion unit. The steering transmission can now be controlled by the auxiliary motor.

In a fifth step 305, the reference steering angles detected and stored during the diagnostic test are retrieved by the PCB 244. If the diagnostic test was not completed, then previously stored reference angle values from the last previously performed successful diagnostic test are retrieved. When a malfunction is detected during start-up, both the propulsion unit and the auxiliary angle sensor are located in their default midship positions. The reference angle representing the current position of the angle sensor, in this case a one-turn potentiometer, at the end of the diagnostic test corresponds to the straight-ahead, or midship, position of the steerable propulsion unit. In this way, the angle sensor of the auxiliary steering system is calibrated and takes on the function of the main steering angle sensor. The steering angle representing the straight-ahead position is indicated by the mechanical indicator on the housing of the auxiliary steering system when the auxiliary helm, a rocker switch in this example, is used for steering. Alternatively, the steering angle representing the straight-ahead position can be transmitted to the main helm, where it is shown to the operator on a display.

In a sixth step 306, the operator can then control the main steering system from the auxiliary helm, or from the main helm desired. In this example, the main helm is used, whereby a steering angle command from the operator is transmitted to the PCB. The PCB will control the auxiliary steering motor in the desired direction while monitoring the steering angle signal from the auxiliary angle sensor. In a seventh step 307 the PCB will compare the current steering angle to the desired steering angle command from the operator. The PCB will control the auxiliary steering motor in the desired direction until the current steering angle corresponds to the desired steering angle. When the desired steering angle is achieved, the process proceeds to an eight step 308 and ends.

It is to be understood that the present invention is not limited to the embodiments described above and illustrated in the drawings; rather, the skilled person will recognize that many changes and modifications may be made within the scope of the appended claims.

The invention claimed is:

1. A method for controlling an electrical steering system in a marine vessel comprising at least one steerable propulsion unit, the electrical steering system comprising a main steering system that comprises a main electric motor and a main power source providing electrical power to the main steering system;

a main steering angle sensor arranged to detect the steering angle of the propulsion unit; a main control unit arranged to steer the propulsion unit in response to an input from an operator and to monitor the main steering system status;

an auxiliary steering system comprising an auxiliary electric motor and an auxiliary battery providing electrical power to the auxiliary steering system;

and an auxiliary clutch arranged to connect a drive shaft of the auxiliary electric motor to the input shaft of the steering transmission in order to steer the propulsion unit;

the method comprising:

engaging the auxiliary clutch at start-up of the propulsion unit;

performing a diagnostic test of the main steering system during start-up of the propulsion unit;

performing a calibration of an auxiliary steering angle sensor in the auxiliary steering system; and disengaging the auxiliary clutch upon completion of the diagnostic test.

2. A method according to claim 1, characterized by calibrating the auxiliary steering angle sensor by measuring multiple reference steering angles using the main steering angle sensor and storing output values from the auxiliary steering angle sensor for each reference steering angle in an auxiliary control unit.

3. A method according to claim 2, characterized by storing angle sensor outputs for reference steering angles corresponding to a midship position and at least one further steering angle during start-up of the propulsion unit.

4. A method according to claim 1, characterized by maintaining the auxiliary clutch engaged when a malfunction is detected in the main steering system during the diagnostic test.

5. A method according to claim 4, characterized by using the auxiliary control unit to control the steering system and calculating the steering angle of the propulsion unit using the stored reference angle output values and detected angle output values from the auxiliary steering angle sensor.

6. A method according to claim 1, characterized by the steps of:

detecting a malfunction in the main steering system during operation of the vessel; and rotating the auxiliary steering angle sensor into an angular position corresponding to the current steering angle of the propulsion unit prior to engaging the auxiliary clutch.

7. A method according to claim 6, characterized by the further steps of:

calculating the angle output value for the auxiliary steering angle sensor corresponding to the current steering angle of the propulsion unit using the stored reference angle output values;

controlling the auxiliary motor to rotate the auxiliary steering angle sensor into an angular position corresponding to the current steering angle of the propulsion unit;

engaging the auxiliary clutch; and using the auxiliary control unit to control the steering system and calculating the steering angle of the propulsion unit using the stored reference angle output values and detected angle output values from the auxiliary steering angle sensor.

8. A method according to claim 1, characterized by the steps of:

detecting a malfunction in the main steering system during operation of the vessel;

engaging the auxiliary clutch;

setting the output value of the auxiliary steering angle sensor equal to the current steering angle of the propulsion unit at the time of engagement; and using the auxiliary control unit to control the steering system and calculating steering angles of the propulsion unit using the stored reference angle output values and detected angle output values from the auxiliary steering angle sensor.

9. A method according to claim 1, characterized by the further steps of:

transmitting a requested steering angle from an operator to the auxiliary control unit;

determining a required displacement of the auxiliary steering angle sensor for achieving the requested steering angle, based on stored auxiliary steering angle sensor output values representing a number of reference angles; and controlling the auxiliary electric motor to steer the propulsion unit to the steering angle requested by the operator.

10. An electrical steering system in a marine vessel comprising at least one steerable propulsion unit; the electrical steering system comprising:

a main steering system comprising a main electric motor and a main power source providing electrical power to the main steering system;

a main steering angle sensor detecting the steering angle of the propulsion unit;

a main control unit arranged to actuate the main electric motor to steer the propulsion unit in response to an input from an operator and to monitor the main steering system status;

characterized in that the electrical steering system further comprises:

an auxiliary steering system comprising an auxiliary electric motor and an auxiliary battery providing electrical power to the auxiliary steering system; and an auxiliary clutch arranged to connect a drive shaft of the auxiliary electric motor to the input shaft of the steering transmission in order to steer the propulsion unit; and an auxiliary control unit arranged to actuate the auxiliary electric motor to steer the propulsion unit in response to an input from an operator;

wherein the auxiliary clutch is arranged to be engaged when a fault is detected in the main steering system.

11. An electrical steering system according to claim 10, characterized in that the auxiliary control unit is arranged to detect and store auxiliary steering angle sensor output values corresponding to multiple reference steering angles measured by the main steering angle sensor during start-up of the propulsion unit.

12. An electrical steering system according to claim 11, characterized in that the auxiliary steering angle sensor is located on the output shaft of an auxiliary transmission connected to the auxiliary electric motor.

13. An electrical steering system according to claim 12, characterized in that the auxiliary steering angle sensor is a one-turn potentiometer.

14. An electrical steering system according to claim 10, characterized in that the drive shafts of the main electric motor and the auxiliary electric motor are coaxial.

15. A marine vessel with a steerable propulsion unit comprising an electrical steering system according to claim 10.

* * * * *